United States Patent [19]

Wormmeester

[11] Patent Number: 4,878,587

[45] Date of Patent: Nov. 7, 1989

[54] POSITIONING APPLIANCE

[75] Inventor: Gerhardus J. Wormmeester, Zwijndrecht, Netherlands

[73] Assignee: Europe Container Terminus B.V., Rotterdam, Netherlands

[21] Appl. No.: 181,821

[22] Filed: Apr. 14, 1988

[30] Foreign Application Priority Data

Apr. 15, 1987 [NL] Netherlands ..... 8700893

[51] Int. Cl.[4] ..... B66C 13/08

[52] U.S. Cl. ..... 212/271; 193/38; 193/41; 212/213

[58] Field of Search ..... 193/38, 41; 414/397, 414/399, 401; 212/271, 213

[56] References Cited

U.S. PATENT DOCUMENTS

| | | |
|---|---|---|
| 3,426,878 | 2/1969 | Campbell, Jr. et al. . |
| 3,494,259 | 2/1970 | Sumida . |
| 3,494,491 | 2/1970 | Sumida . |
| 3,655,081 | 4/1972 | Monk . |
| 4,046,265 | 9/1977 | Wormmeester . |
| 4,049,132 | 9/1977 | Stromback . |
| 4,293,077 | 10/1981 | Makino . |

FOREIGN PATENT DOCUMENTS 7209613 1/1974 Netherlands .

*Primary Examiner*—Sherman D. Basinger
*Assistant Examiner*—Thomas J. Brahan
*Attorney, Agent, or Firm*—Bachman & LaPointe

[57] ABSTRACT

A positioning appliance for accurately positioning a container suspended on crane cables with respect to a chassis on which the container is being placed comprises two slide chutes (30, 31) which are each pivotably suspended on a carriage (32 and 33 respectively). The carriages can be moved along a rail (34). In order to make the appliance suitable for any type of chassis whatsoever, including a chassis suitable for the public highway, the slide chutes must not come into contact with the chassis. The appliance according to the invention makes this possible in that a spacer (37) which can be moved in the direction of movement of the carriages is disposed between the carriages. Each carriage is provided with a stopping device (38 and 39 respectively) which can be brought into engagement with the spacer by moving said carriages. Hydraulic or pneumatic cylinders (35, 36) for moving both carriages are so coordinated in the event of contact between the two stopping devices and the spacer that the carriages, the stopping devices and the spacer are able to move as one unit.

3 Claims, 1 Drawing Sheet

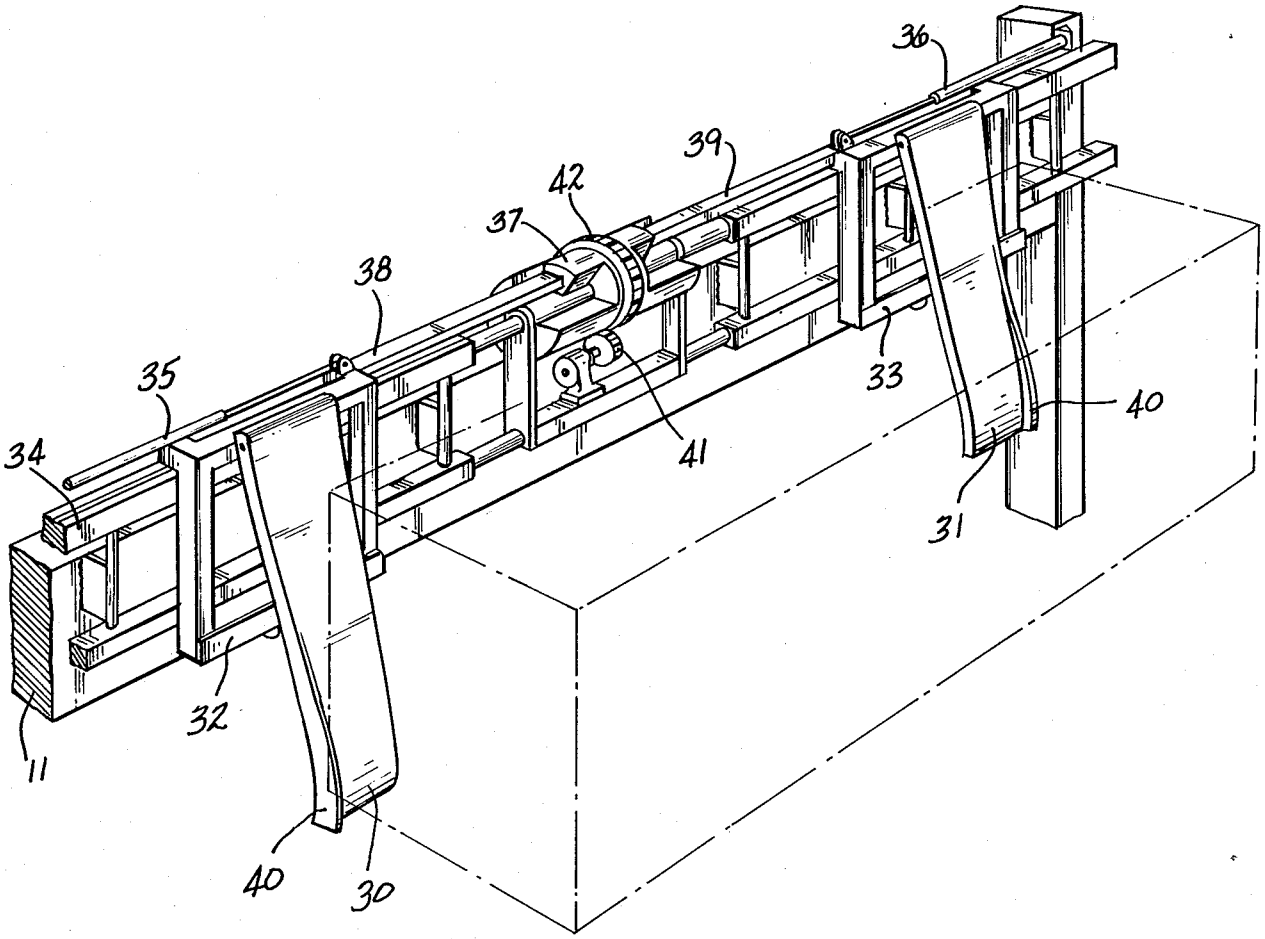
40
31
36
33
39
41
42
37
38
30
40
32
35
34
11

POSITIONING APPLIANCE

BACKGROUND OF THE INVENTION

The invention relates to a positioning appliance for positioning a container suspended on crane cables, comprising two slide chutes which are pivotably suspended at their top end on a carriage, actuating means for pivoting the slides and actuating means for moving the carriages.

Such an appliance is known from the published Dutch patent specification 72.09613 and is an aid in the centred placing of a container on a chassis. In the positioning state the slide chutes engage on said chassis and are able to move by moving the carriages in the longitudinal direction of the chassis, the contact devices of the slide chutes sliding along the chassis. The container can be positioned both in the longitudinal and transverse direction with respect to a chassis which is to be loaded. Because the slide chutes have to come into contact with the chassis during positioning, said chassis has to be of a specific design: the so-called terminal chassis type. The known appliance is unsuitable for positioning a container with respect to any construction whatsoever of a road chassis.

SUMMARY OF THE INVENTION

The object of the invention is to eliminate this drawback and to provide the appliance mentioned in the introduction, the slide chutes of which do not have to engage on the chassis to be loaded during operation, a simple positioning of the container nevertheless being possible in the transverse and longitudinal direction.

According to the invention, the positioning appliance is characterized for this purpose in that a spacer which can be moved in the direction of movement of the carriages is disposed between the carriages, in that each carriage is provided with a stopping device which can be brought into engagement with said spacer by moving said carriage and in that means are present to coordinate the actuating means for moving the carriages, when there is contact between the two stopping devices and the spacer, so that the carriages, the stopping devices and the spacer move as one unit.

In order to be able to adapt the positioning appliance readily to a number of container length dimensions, the spacer can be adjusted in a manner such that the distance between the slide chutes determined by the stopping of the stopping devices at the spacer can be adapted to the length of a container.

For example, the spacer is constructed in the form of a rotatable cylinder with a number of segments which have different lengths in the direction of movement of the spacer.

BRIEF DESCRIPTION OF THE DRAWINGS

The invention will not be explained in more detail with reference to the figure which shows an exemplary embodiment.

DETAILED DESCRIPTION

The appliance is intended to position a container suspended by means of a spreader on cables of a container crane with respect to a loading chassis in a manner such that the container can be accurately placed on said chassis. At the same time, the loading chassis is of any type whatsoever. The positioning appliance is, for example, attached to the frame 11 of the container crane. The container is indicated with chain dot lines.

The appliance comprises two slide chutes 30, 31 which are pivotably suspended on a carriages 32 and 33 respectively. Said carriages are displaceable or drivable by means of hydraulic or pneumatic cylinder 35 and 36 respectively on a rail 34. Between the carriages there is a spacer 37 which is likewise movable on the rail 34. Each of the carriages 32, 33 has a stopping device in the form of a rod 38 and 39 respectively which can come up against the spacer 37. Spacer 37 is constructed in the form of a cylinder with a number of segments of different length.

The slide chutes 30, 31 are provided with an edge 40. The dimensions of the segments of the spacer 37 are so chosen that when the stopping rods 38, 39 engage thereon, the distance between the edges 40 of the slide chutes is only slightly greater than the length of a container. It will be clear that the various segments of the spacer cylinder 37 correspond to the various container lengths.

This embodiment operates as follows. As soon as a container is brought by the crane between the slide chutes 30, 31, the cylinders 35, 36 are actuated. The stopping rods 38 and 39 respectively come into engagement with the spacer 37, the angular position of which is adjusted by means of a driven gear wheel 41 for the purpose of adapting to the length of the container concerned. The stopping position of the rods 38, 39, the container fits precisely between the edges 40. By now moving the carriages 32, 33 simultaneously by means of the cylinders 35, 36 (increasing the pressure to some extent in the case of one cylinder and lowering it somewhat in the case of the other) and by changing the pivoting position of the chutes 30, 31 by means of cylinders which are not shown, the container can readily be positioned so that, while moving with a certain spacing of the chutes, it will take up a desired position on any chassis whatsoever.

It is important that the chutes 30, 31 do not come into contact with the loading chassis on which the container is being place. Other constructions are conceivable for the spacer 37. It may be constructed in the form of two concentric cylinders which are displaceable with respect to each other and which can be fixed in different positions.

What is claimed is:

1. A positioning appliance for positioning a container suspended on crane cables, comprising: two carriages; two slide chutes having top ends each of which is pivotably suspended at their top ends on one of said carriages; actuating means for pivoting the slide chutes; actuating means for moving the carriages; a spacer movable in the direction of movement of the carriages disposed between the carriages; a stopping device associated with each carriage operative to be brought into engagement with said spacer by moving the respective carriage; and means to coordinate the actuating means for moving the carriages, when there is contact between the two stopping devices and the spacer, so that the carriages, the stopping device and the spacer move as one unit.

2. Positioning device according to claim 1 wherein the spacer is adjustable in a manner such that the distance between the slide chutes determined by the stopping of the stopping devices at the spacer can be adapted to the length of a container.

3. Positioning device according to claim 1 wherein the spacer is in the form of a rotatable cylinder with a number of segments which have different lengths in the direction of movement of the spacer.

* * * * *